US012618585B2

(12) United States Patent
Nilsson et al.

(10) Patent No.: US 12,618,585 B2
(45) Date of Patent: May 5, 2026

(54) DISTRIBUTED PEOPLE COUNTING SYSTEM AND METHODS

(71) Applicant: SCHNEIDER ELECTRIC BUILDINGS AMERICAS, INC., Carrollton, TX (US)

(72) Inventors: Leif Roger Torbjörn Nilsson, Södra Sandby (SE); Peter Sven Anders Lindgren, Bunkeflostrand (SE)

(73) Assignee: SCHNEIDER ELECTRIC BUILDINGS AMERICAS, INC., Carrollton, TX (US)

( * ) Notice: Subject to any disclaimer, the term of this patent is extended or adjusted under 35 U.S.C. 154(b) by 384 days.

(21) Appl. No.: 17/993,202

(22) Filed: Nov. 23, 2022

(65) Prior Publication Data

US 2023/0160598 A1 May 25, 2023

Related U.S. Application Data

(60) Provisional application No. 63/282,983, filed on Nov. 24, 2021.

(51) Int. Cl.

| | |
|---|---|
| ***F24F 11/00*** | (2018.01) |
| ***F24F 11/63*** | (2018.01) |
| ***F24F 11/80*** | (2018.01) |
| *F24F 110/50* | (2018.01) |
| *F24F 120/10* | (2018.01) |

(52) U.S. Cl.
CPC ..... *F24F 11/80* (2018.01); *F24F 11/63* (2018.01); *F24F 2110/50* (2018.01); *F24F 2120/10* (2018.01)

(58) Field of Classification Search
CPC ..... F24F 11/63; F24F 11/80
See application file for complete search history.

(56) References Cited

U.S. PATENT DOCUMENTS

2018/0336420 A1* 11/2018 Pandharipande ..... G06V 40/10
2021/0235172 A1* 7/2021 Wohlschlager ..... H04Q 9/00

FOREIGN PATENT DOCUMENTS

WO 2017108374 A1 6/2017

OTHER PUBLICATIONS

International Search Report and Written Opinion dated Mar. 3, 2023 for corresponding International Patent Application No. PCT/US2022/050846, 67 pages.

* cited by examiner

*Primary Examiner* — Mark A Connolly
(74) *Attorney, Agent, or Firm* — FIG. 1 Patents

(57) ABSTRACT

System and methods for counting people in a space that is monitored by a plurality of distributed sensors are disclosed. In some embodiments, the method includes receiving a people count value output by a first sensor monitoring a portion of a space. The first sensor is one of a plurality of distributed sensors monitoring non-overlapping portions of the space. The method further includes waiting to receive additional people count values output by other sensors monitoring other portions of the space and then determining a total count of people in the space in response to receiving the additional people count values and determining that the received people count values are synchronized in time. In response to determining the total count of people in the space, one or more actions may be performed.

16 Claims, 12 Drawing Sheets

DISTRIBUTED PEOPLE COUNTING SYSTEM AND METHODS

CROSS-REFERENCE TO RELATED PATENT APPLICATION(S)

This application claims the benefit of and priority to U.S. Provisional Application No. 63/282,983, filed on Nov. 24, 2021, which application was filed under 35 U.S.C. § 119(e) and is incorporated by reference herein in its entirety.

TECHNICAL FIELD

This disclosure is generally related to people counting and more particularly to system and methods for people counting in a space that is monitored by multiple distributed people counting sensors.

BACKGROUND

Occupancy sensors are indoor motion detection devices that detect the presence of a person or persons to automatically control temperature, lights, etc. Most common occupancy sensors use passive infrared technology to detect the presence of people. Occupancy sensors can indicate only whether a room, for example, is occupied or not. People counting sensors, on the other hand, are devices that can detect and count the number of people within their field of view. People counting sensors may be based on a number of technologies such as video processing, radar, thermal imaging technology, and the like.

SUMMARY

Embodiments of the disclosed system includes a method for counting people in a space that is monitored by a plurality of distributed sensors. The method includes receiving a people count value output by a first sensor monitoring a portion of a space. The first sensor may be one of a plurality of distributed sensors synchronized in time and monitoring non-overlapping portions of the space. The method further includes waiting to receive additional people count values output by other sensors monitoring other portions of the space. The method then determines a total count of people in the space in response to receiving the additional people count values and determining that the received people count values are synchronized in time. In response to determining the total count of people in the space, one or more actions may be performed. The one or more actions may be related to improving energy efficiency and comfort and/or enhancing indoor air quality in some implementations. The one or more actions may also include alerting facility/safety managers when the number of people in a space exceeds the maximum or some threshold capacity for the space.

Embodiments of the disclosed system includes a system for counting people in a space that is monitored by a plurality of distributed sensors. The system may comprise a plurality of controllers including a master controller comprising a people counting segment object having a people counting segment input. The segment input may be configured to receive a people count value output by a first sensor monitoring a portion of a space, wherein the first sensor is one of a plurality of distributed sensors monitoring non-overlapping portions of the space, wherein each sensor is hosted by a controller from the plurality of controllers, and each controller receives a people count value output by its respective sensor and forwards it to the master controller. The segment input may be configured to wait to receive additional people count values output by other sensors monitoring other portions of the space and determine a total count of people in the space in response to receiving the additional people count values and determining that the received people count values are synchronized in time. The master controller may be configured to perform one or more actions in response to determining the total count of people in the space.

Embodiments of the disclosed system also includes a non-transitory computer-readable medium storing one or more programs comprising instructions which when executed by a machine, cause the machine to perform a method for counting people in a space that is monitored by a plurality of distributed sensors. The method may include receiving a people count value output by a first sensor monitoring a portion of a space, wherein the first sensor is one of a plurality of distributed sensors monitoring non-overlapping portions of the space and wherein the plurality of distributed sensors are in communication with a plurality of controllers and synchronized in time. The method may include waiting to receive additional people count values output by other sensors monitoring other portions of the space, determining, at a master controller from the plurality of controllers, a total count of people in the space in response to receiving the additional people count values and determining that the received people count values are synchronized in time and performing one or more actions in response to determining the total count of people in the space.

In some implementations, the waiting may be for a predefined period of time that is triggered each time a people count value output by a sensor from the plurality of sensors is received. In other implementations, the waiting may be for a predefined period of time that is triggered by receiving of the people count value output by the first sensor.

In various embodiments, the master controller includes a people counting segment object having the people counting segment input that combines the received people counting values to determine the total count of people in the space.

In various embodiments, the people count value is a complex value having a people count value component and a timing component and wherein the timing component of the people count values are compared with each other to determine that the people count values are synchronized in time.

In some implementations, the one or more actions include: automatically adjusting one or more parameters relating to indoor environment quality (IEQ) based on the total count of people in the space.

In some implementations, the one or more actions include: automatically adjusting one or more parameters of an HVAC system based on the total count of people in the space.

In some implementations, the one or more actions include: providing the total count of people in the space to a room control unit or a thermostat for controlling the climate condition of the space based on the total count of people in the space.

In some implementations, the method includes determining that a total count of people cannot be accurately calculated in response to determining that at least one of the received people count values is not synchronized in time with the other of the received people count values or was not received during a predefined time period.

In some implementations, the sensor may be one of a: multi-sensor comprising a plurality of sensors including a people counting sensor or a discrete people counting sensor.

Other embodiments and implementations are disclosed and each of the embodiments can be used alone or together in combination. Additional features and advantages of the disclosed embodiments are described in, and will be apparent from the following Detailed Description and the figures.

DETAILED DESCRIPTION

The present disclosure describes various embodiments and implementations of a distributed people counting system and methods (hereinafter "the disclosed system").

As used herein, a segment is the smallest logical unit describing a space. A space (e.g., a room or a zone) comprises one or more segments. An area comprises one or more rooms. A building comprises one or more areas. A property comprises one or more buildings. Finally, a portfolio comprises one or more properties. Segments within an area may be identified with a view towards flexibility, engineering efficiency (e.g., tradeoff among cost and reusability and maintainability factors) and performance and scalability.

Typically, a people counting sensor is affixed on the ceiling or a wall of a room to detect the presence of people and count the number of people in the room. If the room is large, a single people counting sensor may not cover the entire area of the room and there may be a need to install multiple people counting sensors. In some cases, a room can be joined together with another room or rooms (via rezoning) to create a larger room. This could be accomplished by, for example, opening sliding walls or doors or even by removing one or more walls. In this situation, the distributed people counting sensors must work together to provide a total count of people in the larger room. However, for various reasons, it may not be possible to accurately determine the total count of people in the room based on the sensor data from all the distributed sensors in the room. For example, when the people counting sensors in the room do not continuously calculate or update the count of people, it may not be possible to accurately determine the total count of people in the room. This may be the case when the sensors are low power devices and/or are battery powered, and by determining and/or transmitting the count of people periodically, such sensors can reduce its power consumption. Similarly, the sensor data may need to be transmitted through a distributed system that may result in transmission delays or losses, which can result in inaccurate calculation of the total number of people in the room. Simply adding the output of each people counting sensor in the room would likely result in an inaccurate count of actual people in the room. For example, people counting may be occurring in a dynamic environment where people may be moving from one part of the room to another while each sensor is making its own determination. This may result in the same person being counted by more than one sensor. This case is further described in relation to FIGS. 1A and 1B.

Figure 1A:
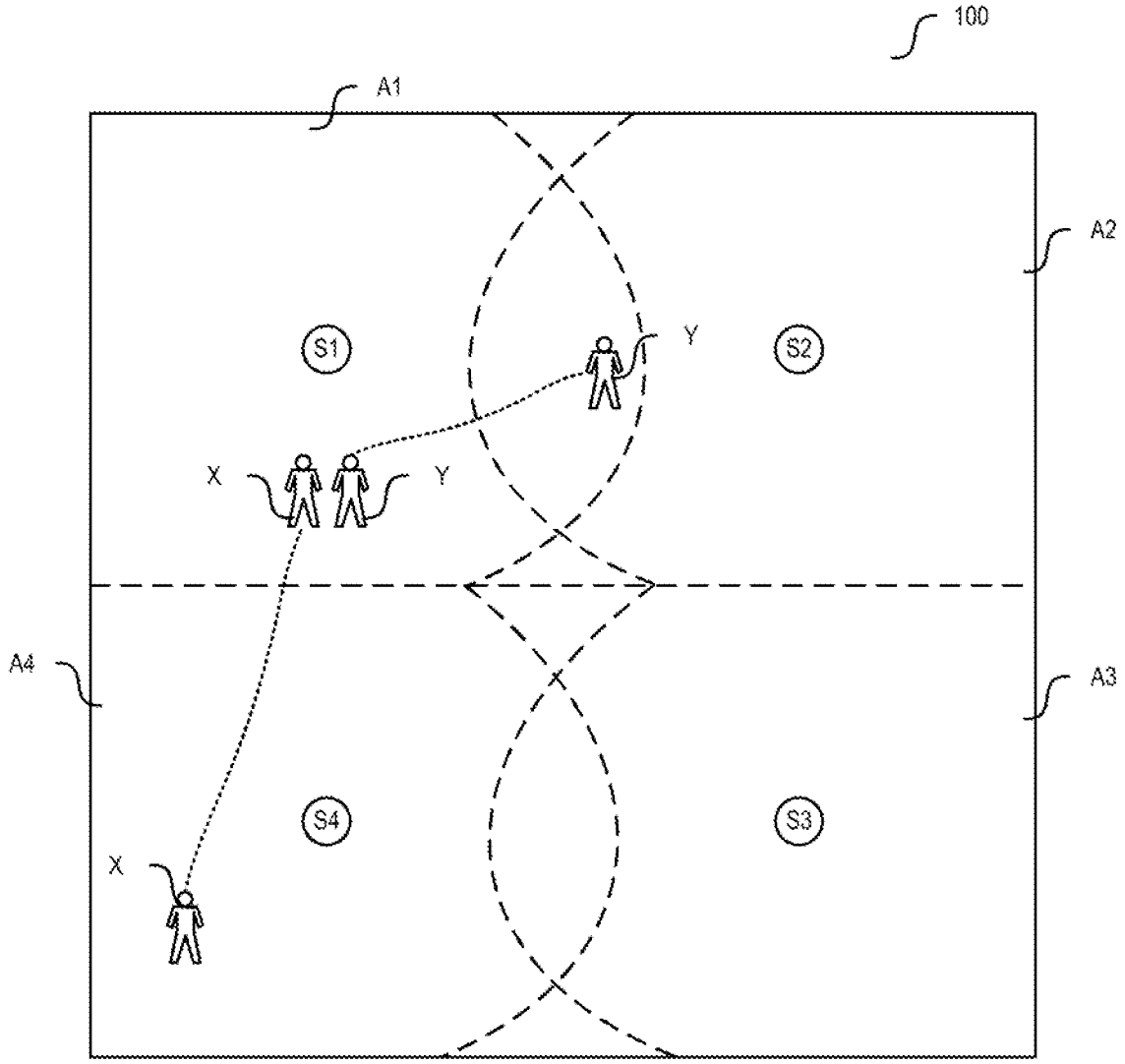
FIGS. 1A and 1B are diagrams illustrating examples of portions of a space monitored by people counting sensors in accordance with some embodiments of the disclosed system.
Figure 1B:
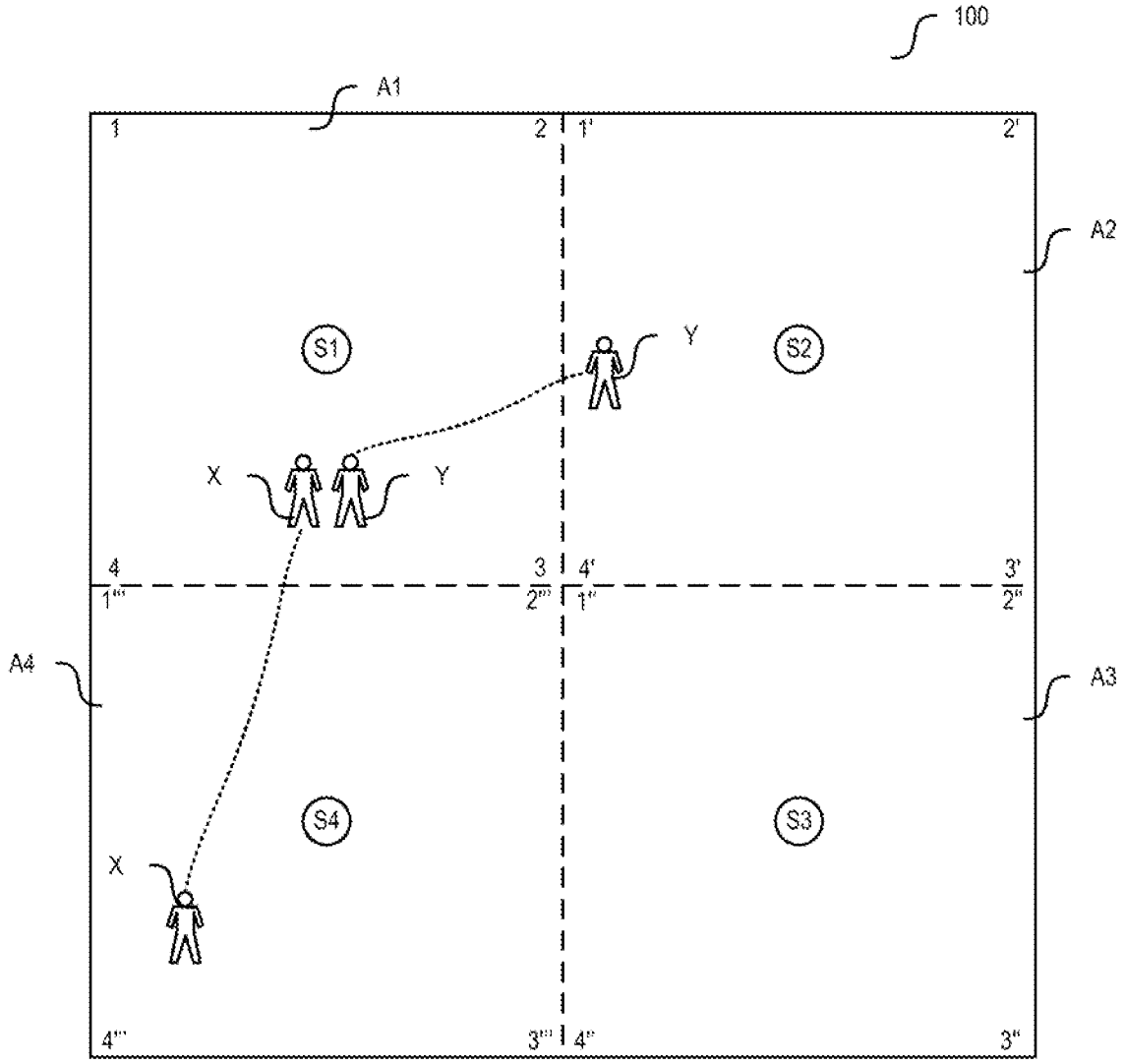

FIG. 1A is a diagram illustrating an example of a space (e.g., room) 100 that comprises of four segments A1, A2, A3 and A4 monitored by four people counting sensors: S1, S2, S3 and S4 respectively. Two people X and Y are observed in segment A1 and counted by sensor S1. After some time, Y moves towards segment S2 in a part of the room that is monitored by both S1 and S2. In this case, Y is counted by both S1 and S2. Similarly, after some time, X moves to segment A4 and is counted by S4. Attempting to simply add the count of values output by S1-S4 in the space would result in an inaccurate output where Y is counted twice. One way to address this problem is by using a masking technique to ensure coverage areas of the sensors do not overlap. FIG. 1B shows the same space 100 that now comprises four non-overlapping segments A1-A4 monitored by people counting sensors S1-S4 respectively. Even after the problem of overlap has been addressed, the total count could still be inaccurate if the sensors are not synchronized in their operation. For example, people X and Y could be counted by S1 at time $T_1$, Y could be counted by S2 at time $T_2$ and X could be counted by S4 at time $T_3$. Simply adding these values would result in an inaccurate counting of the total number of people in the space (e.g., 4 instead of 2 people). This problem is particularly exacerbated when the people counting sensors are configured to count the number of people at intervals (e.g., every 1 or 2 minutes) instead of continuously. Such a configuration may be made in order to reduce power consumption as in the case of low power people counting sensors or those powered by battery. Furthermore, in some implementations, it may be advantageous for the sensors to count the people at intervals in order to limit the amount of outgoing data traffic to the controllers that they are in communication with. Frequent data traffic can be particularly problematic in systems where the sensors are connected to controllers via protocols such as BACnet. Furthermore, in a distributed system which may comprise multiple controllers, and/or with slower networks, there may be transmission delays/losses. Consequently, people count values from all the sensors may not be available instantaneously to determine the total count of people in the space and may result in an inaccurate determination of the actual level of occupancy of the space.

In order to overcome these problems, in the disclosed system, the sensors operate in a synchronized manner. For example, if the sensors S1-S4 are thermal image sensors, then these sensors capture images at the same time. So, at time $T_1$, S1 would capture an image of the segment A1 and process the image to count X and Y. S2, S3 and S4 would also each capture an image at the same time $T_1$ and would process the respective images to count 0 people in A2, A3 and A4.

The disclosed system also provides a segment input dedicated for people counting that waits for all the sensors to report the count of people values from time $T_1$ and then calculates a sum that is an accurate measure of the actual number of people in the space at a particular time, e.g., $T_1$.

The knowledge of the actual level of occupancy of a space (i.e., the total number of people in the space) that is monitored by distributed people counting sensors has a number of uses and benefits. For example, instead of relying on presence, preset values and hours of operation as conventional systems do, the disclosed system can use information about the level of occupancy to control the building proactively. Specifically, the occupancy level information may be used to proactively control indoor environmental/indoor air quality parameters such as temperature, relative humidity, air quality, air flow, lighting levels, and the like in a space to improve occupant comfort, reduce energy consumption, etc. The level of occupancy may also be used to identify under-used spaces and amenities and reallocate them to another purpose. Another use of level of occupancy information may be to identify spaces that are more frequently used and may require enhanced cleaning and maintenance practices for the well-being and health of the occupants. Yet another use of level of occupancy information may be to manage safety and/or recommended social distancing practices to ensure that the number of people in a space does not exceed the maximum or recommended capacity for the space. Similarly, the level of occupancy over a period of time may be used to adapt the overall heating, ventilation and air conditioning (HVAC) of the building to minimize the overall energy footprint of the building while maintaining occupant comfort. The level of occupancy of a space over a period of time may also be analyzed to identify the space usage patterns such as determining the ratio of flexible vs. fixed spaces to generate better layouts (e.g., for an office).

Various aspects of the disclosed system will now be described in further detail.

1. Architecture

Figure 2:
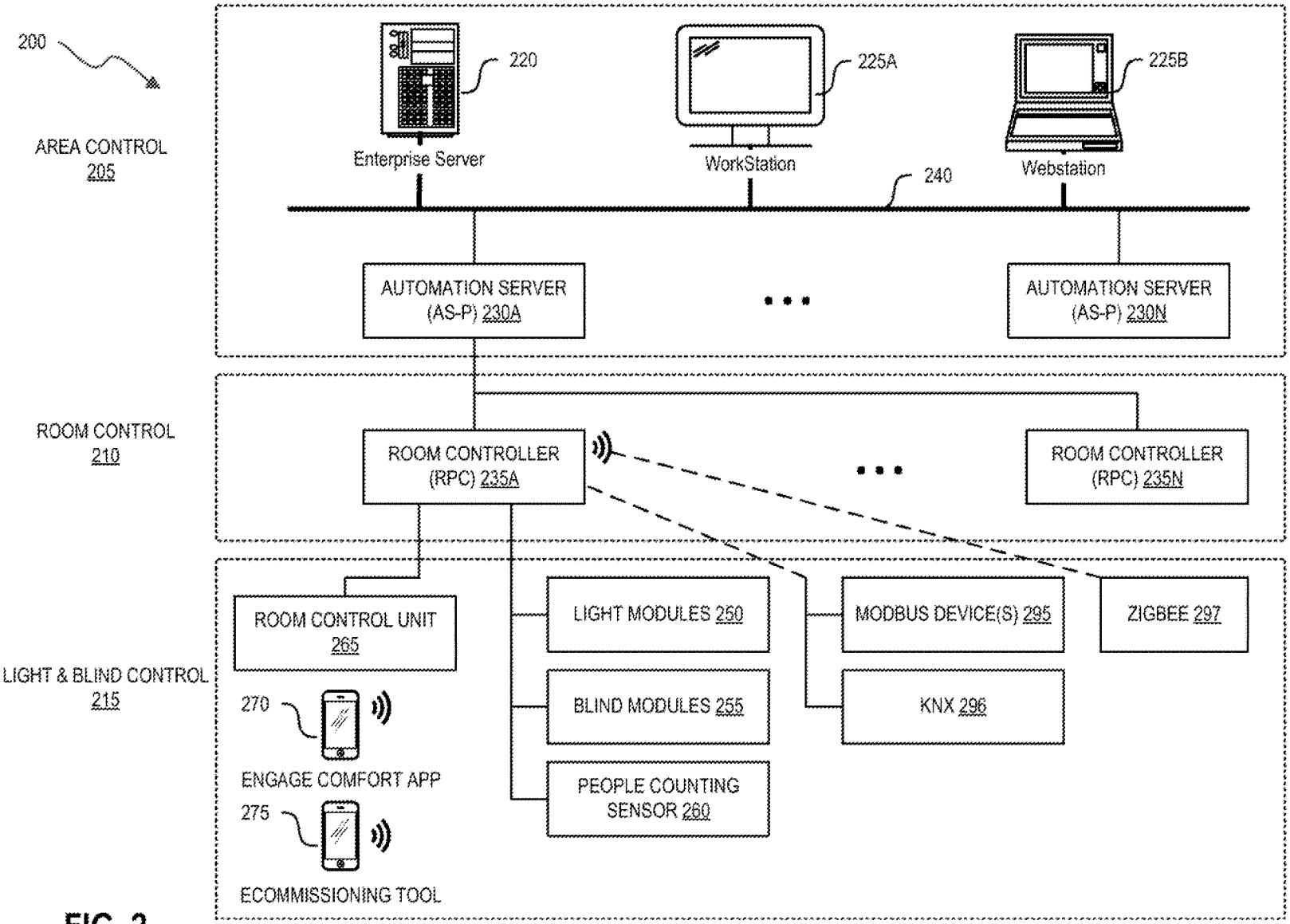
FIG. 2 is a diagram illustrating an example of the architecture of the disclosed system in accordance with some embodiments of the disclosed system.

FIG. 2 is a diagram illustrating an example of the architecture of the disclosed system in some embodiments.

The architecture 200 may comprise three layers of control including area control 205, room control 210 and environmental equipment control 215 (e.g., light control, blind control, HVAC control). The area control 205 level includes building management system such as Schneider Electric's EcoStruxure Building Operation. The building management system software may run in one or more enterprise servers 220 and/or one or more automation servers 230A-N. The building management system software enables building of big systems that integrate many different control systems, third-party systems and a multitude of field bus protocols. Workstations (225A, 225B) and other client devices may be used to access and interact with the building management system software. The enterprise server 220 may be in communication with one or more automation servers 230A-N. The automation servers can perform functionalities such as executing control logic, communications for advanced display, trend logging, alarm supervision, supporting communication and connectivity to the I/O and field buses, and the like. One example of an automation server is AS-P from Schneider Electric. Communication between the automation servers (230A-N), enterprise server (220) and the client devices (225A, 225B) are over an IP backbone network 240.

Each automation server (230A-N) may be in communication with one or more room controllers (235A-N) and may be responsible for management, monitoring and control of room controllers associated with an area. For example, automation server 230A (also referred to as an area controller) may be responsible for monitoring and control of an area which includes room controllers 235A-N. In some embodiments, an automation server (230A-N) may host two or more areas. In some embodiments, it is possible to perform rezoning (i.e., grouping of segments or rooms) only within an area. The room controllers (235A-N) own their own environmental control equipment and drive them. For example, room controller 235A drives a light controller module 250 and blind controller module 255 and is in communication with a people counting sensor 260. The room controller 235A may also be in communication with a room control unit 265 or thermostat (e.g., Schneider Electric's Living Space Room Unit). Mobile applications (270, 275) can connect with the room control unit 265 over a wireless network such as Bluetooth Low Energy (BLE), Zigbee, Wi-Fi, and the like. It should be noted that the room controller 235A may also communicate with other controller modules such as a Modbus device 295, a KNX module 296, Zigbee module 297 and other third-party modules. The room controller may support a number of device connectivity solutions including but not limited to: room bus, sensor bus, Modbus, Zigbee, and the like. One example of a room controller (235A-N) is a Room Purpose Controller (RP-C) from Schneider Electric. An RP-C controller connects with other RP-C controllers and to the AS-P via BACnet IP.

2. Segments and Rezoning

In any given building, the needs of its occupants may change over time or even from day to day. For example, one tenant may want an open floor plan, while another tenant may want a traditional floor plan with offices. Rezoning is a solution that can make it easy to adapt to such changes in the floorplan of a building (e.g., adding or removal of a wall) by synchronizing the operation of the environmental control equipment such as HVAC, lights, blinds, sensors, etc., across the rezoned space. Rezoning solution significantly reduces the time and cost associated with making the changes manually.

One of the problems with implementing rezoning is that the application does not know its environment. For example, an HVAC control application may not know what and how many sensors it should get data from, what user settings to apply or what outputs the application must interact with. One way to solve this problem is applying the concept of segments to resolve the issue on behalf of the application. There are three main types of segment objects:

1. Segment inputs that combine multiple inputs (e.g., sensors, buttons) by applying an algorithm such as but not limited to: average, max, min, logical OR, logical AND, or a combination thereof.
2. Segment settings that synchronize multiple settings to create a shared setting. The end result is that multiple user interfaces connecting in different ways can cooperate to change these values.
3. Segment outputs that allow another application (master) to take ownership of an output and drive it instead of the local application (slave).

In addition to these objects, the segment concept includes a segment folder that stores the segment objects and represents the segment from a rezoning perspective.

Figure 3A:
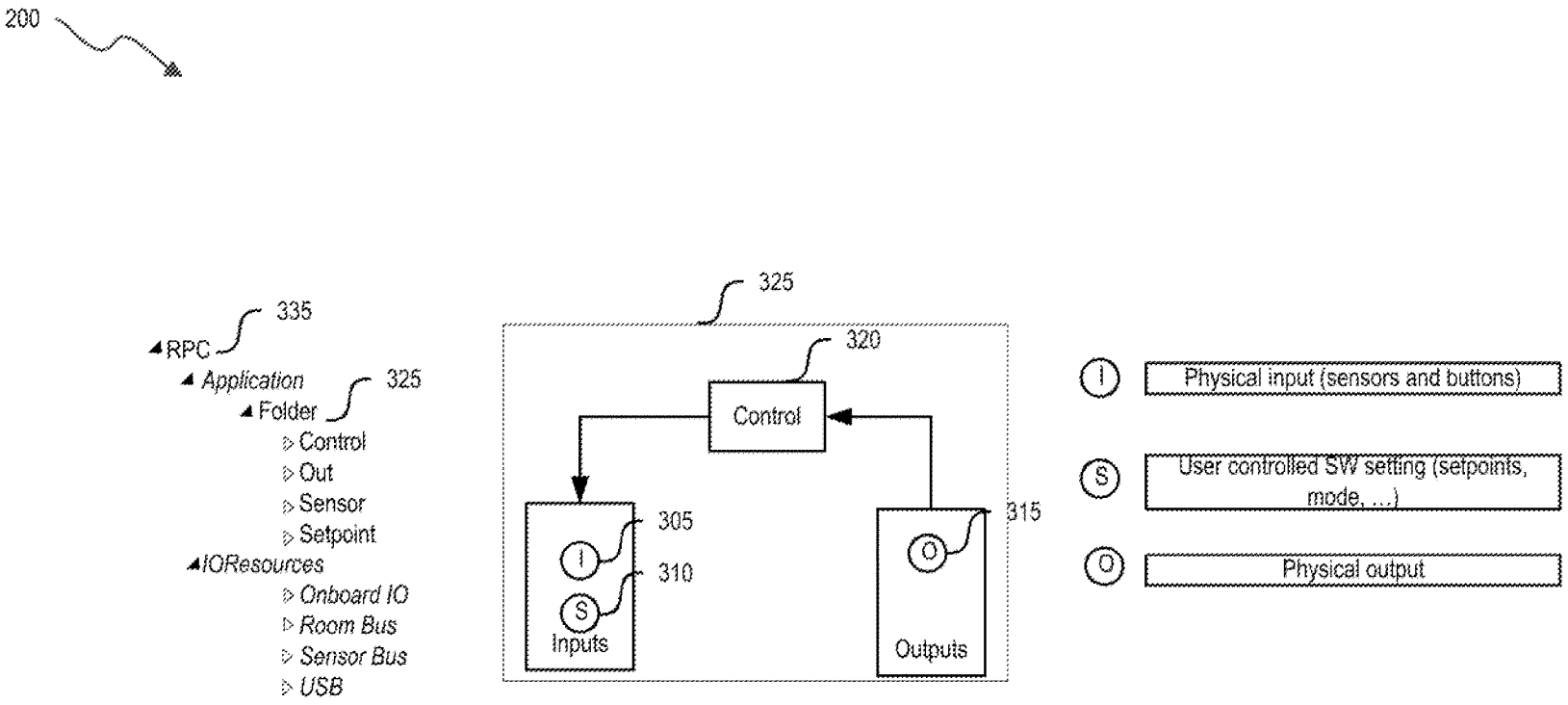
FIG. 3A is a diagram illustrating a segment that is not prepared for rezoning in accordance with some embodiments of the disclosed system.

FIG. 3A is a diagram illustrating the concept of a segment 325 that is not prepared for rezoning in accordance with some embodiments of the disclosed system. As depicted, a control program 320 interacts with one physical input 305 ("I"), one user setting 310 ("S") and produces one physical output 315 ("O"). These reside in a folder 325 hosted by a room controller 335.

Figure 3B:
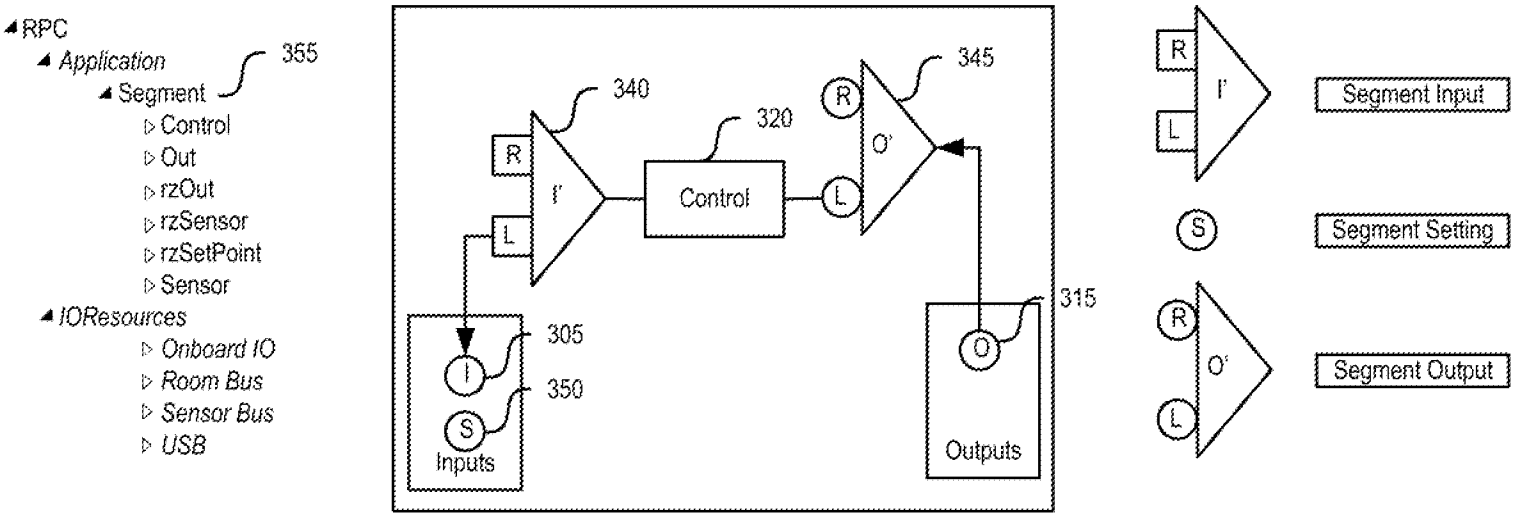
FIG. 3B is a diagram illustrating a segment that is ready for rezoning in accordance with some embodiments of the disclosed system.

Referring to FIG. 3B, to make this application rezoneable, the folder is converted into a segment folder 355 by inserting a segment input 340 between the physical input 305 and the control application 320, and a segment output 345 between the control application 320 and the physical output 315. Finally, the setting 310 (from FIG. 3A) is changed to a segment setting 350. The folder 325 (from FIG. 3A) is changed to a segment folder 355.

Figure 3C:
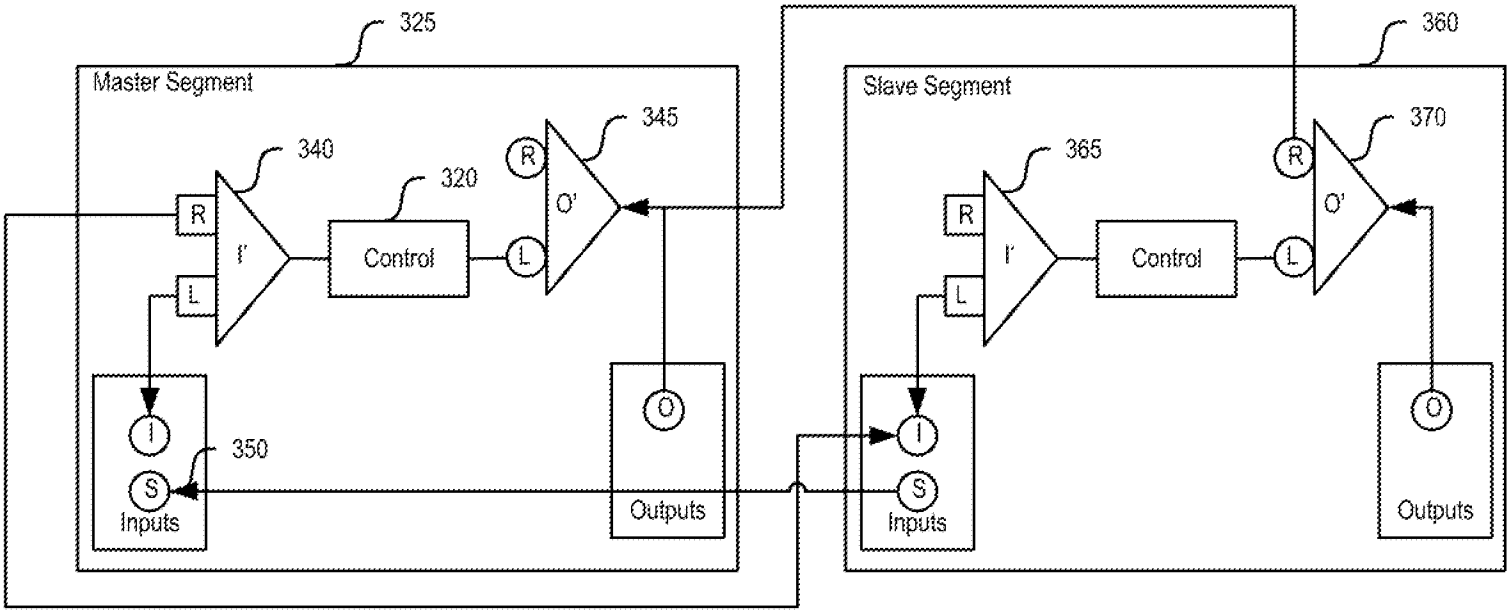
FIG. 3C is a diagram illustrating grouping of two segments in accordance with some embodiments of the disclosed system.

The disclosed system, during rezoning, can group multiple segments together and designate one of them as the master. Referring to FIG. 3C, segment 325 and segment 360 are shown to be grouped together to create a zone. Segment 325 is the master, while segment 360 is the slave. The segment input 340 of the master combines all inputs of the same kind from the master segment 325 and the slave segment 360 and calculates a resulting value for the master control program 320 to use. The slave segment output 370 follows the segment output 345 of the master control program 320. The setting 350 is shared between the two segments and can be changed anywhere (e.g., via an interface associated with the master segment 325 or the slave segment 360).

Figure 4:
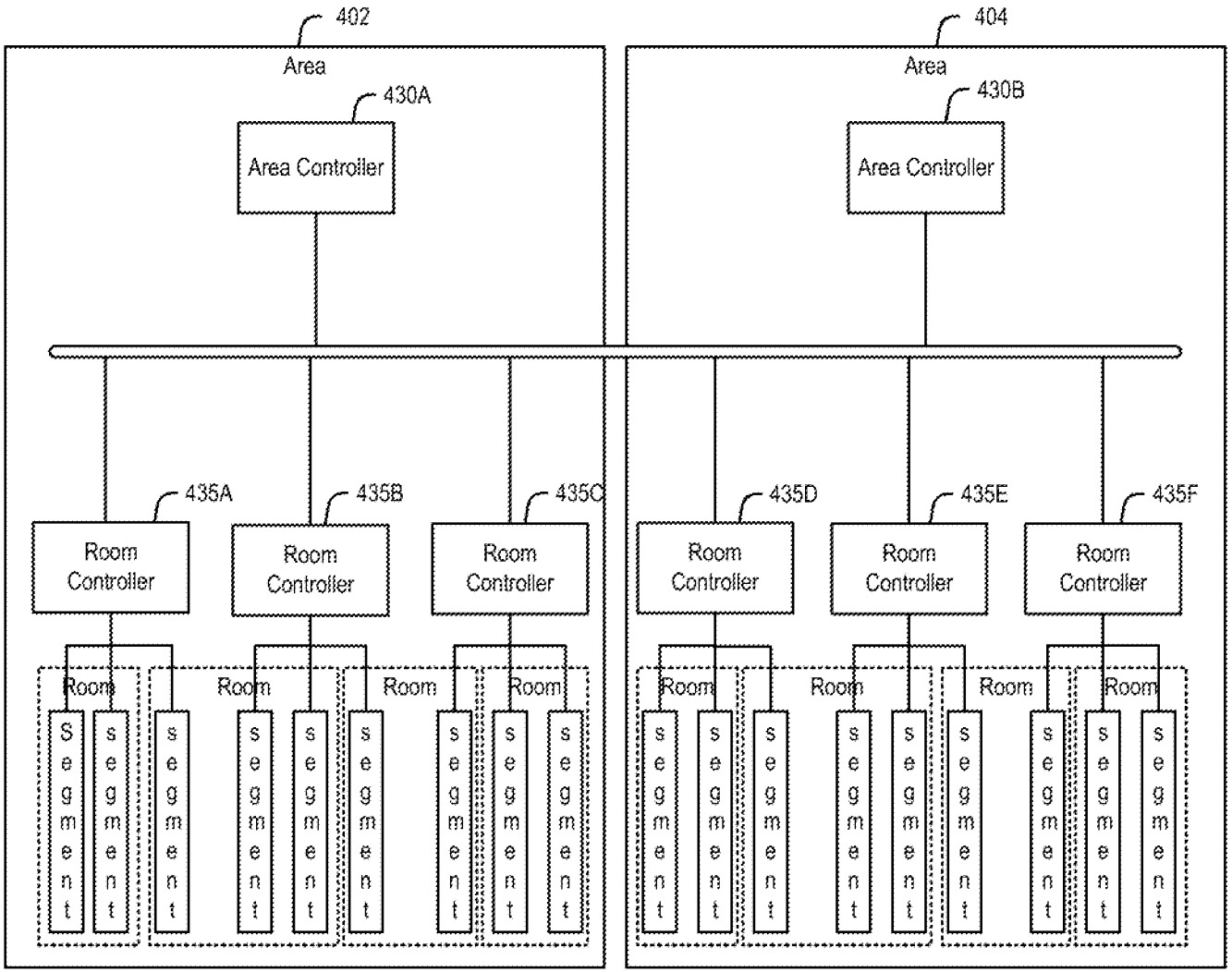
FIG. 4 is a diagram illustrating grouping of segments within an area in accordance with some embodiments of the disclosed system.

Referring to FIG. 4, two areas 402 and 404 managed by area controllers 430A and 430B respectively are depicted. Area 402 includes multiple room controllers (435A-C) and each room controller, in turn, can have multiple devices connected to it through different buses. During rezoning, multiple segments within an area are grouped together. A room can thus be formed by having multiple room controllers working together. A segment input of the master room controller combines multiple input values by collecting information from a highly distributed system.

3. Distributed People Counting

Figure 5:
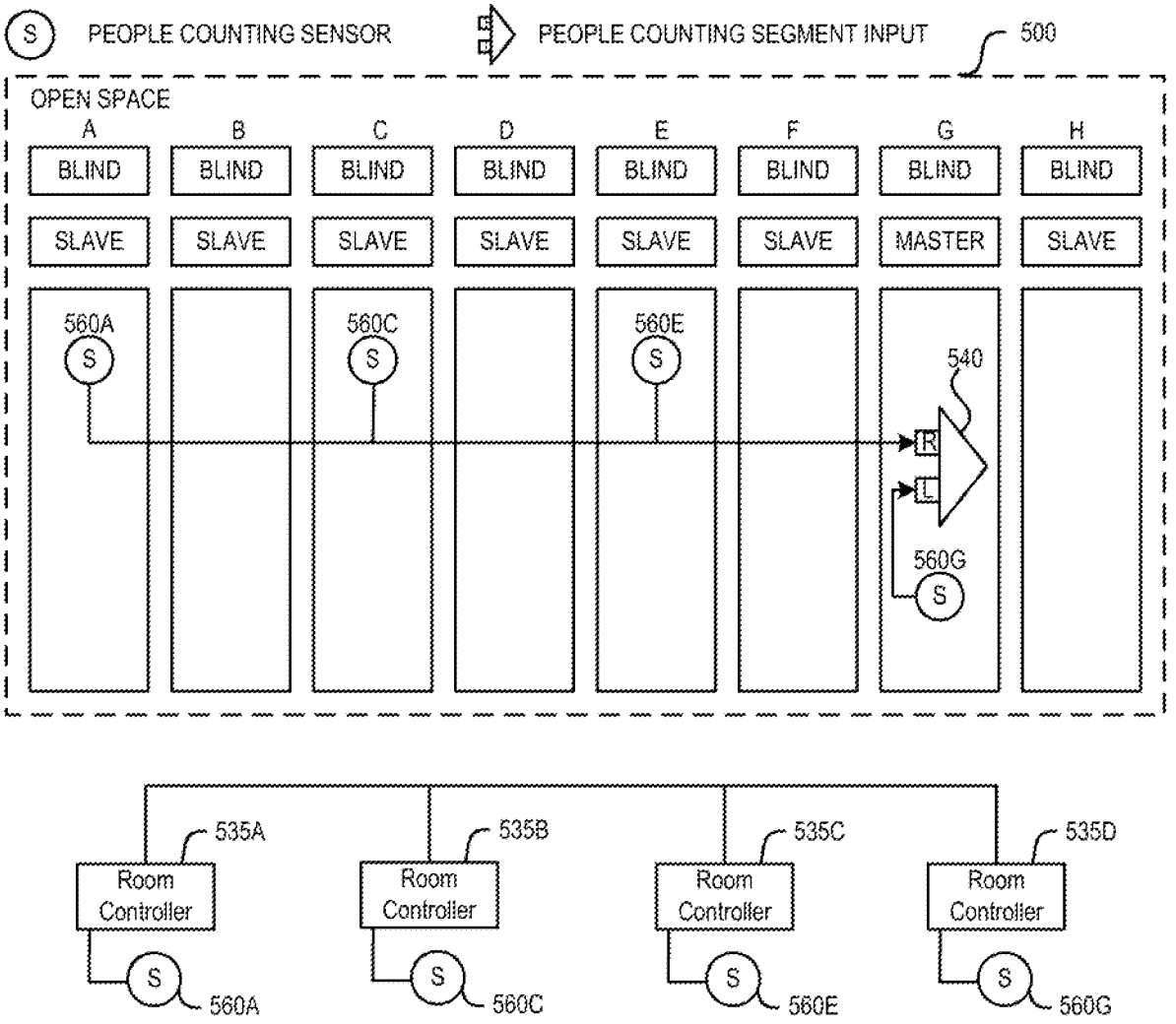
FIG. 5 is a diagram illustrating an example of a people counting segment input in operation in accordance with some embodiments of the disclosed system.

FIG. 5 is a diagram illustrating an example of a people counting segment input in operation in accordance with some embodiments of the disclosed system.

An open space 500 includes a plurality of segments A-H, of which segment G is designated a master while the rest of the segments are designated slaves. Segment A includes a people counting sensor 560A monitoring a portion of the space 500. Similarly, segment C includes a people counting sensor 560C, segment E includes people counting sensor 560E and master segment G includes people counting sensor 560G monitoring respective non-overlapping portions of the space. The four sensors 560A, 560C, 560E and 560G work together with the respective room controllers 535A, 535B, 535C and 535D to monitor the space for people. It should be noted that in some implementations, the people counting sensor (560A, C, E, G) may be a sensor unit with the sole purpose of determining the number of people in a portion of the space that it monitors. In other implementations, the people counting sensor may be a multi-sensor that includes multiple functions including people counting. Examples of other functions that such a multi-sensor may include detecting and/or measuring environment parameters such as noise (e.g., through a microelectromechanical system (MEMS) microphone), room level luminosity, infrared motion detection, temperature, relative humidity, carbon dioxide, carbon monoxide or other gases, volatile organic compounds, particulate matter, and the like. The people counting sensor may determine the number of people in a space by using various technologies. In some implementations, the people counting sensor uses a thermal imaging sensor. One example of a people counting sensor is the Insight sensor from Schneider Electric.

The people counting sensors may connect to the room controllers via a room bus. In some implementations, the sensors may connect to the room controllers via alternative wireless means such as Bluetooth Low Energy. The room controllers may communicate with one another over BACnet IP. The people counting sensors are synchronized by the room controllers, which in turn are synchronized by the host automation server and/or the enterprise server. Each people counting sensor (e.g., using thermal imaging sensor) can be configured to capture an image at the same time at specific time intervals. By way of example only, the time interval may be configured to be 2 minutes. The captured image is compared to the background image which is a baseline with no people present to allow people count calculation.

The people count values calculated at people counting sensors 560A, 560C, 560E and 560G are sent to the hosting room controllers 535A, 535B, 535C and 535D respectively. Specifically, the people count values from the sensors bind to the people counting segment inputs in the hosting room controllers. The people count value, in various implementations, may be a value with integer data type (e.g., people count value of 5 indicating observance of 5 people in a space). In other implementations, the people count value may be a complex value having a count value (e.g., integer data type) and timing information relating to the time of capture of the image (e.g., a time stamp). For example, a people count sensor may output a complex value that comprises a count value of 5 and minute number 8 indicating that at minute number 8, the sensor captured the thermal image which was processed to detect the presence of 5 people in the portion of the space it was monitoring. The people count values that are sent to the hosting room controllers are forwarded to the segment input 540 in the master room controller 535D where the people count values that are in sync (i.e., have the same timing information) are combined (by a control program) to determine the total number of people in the open space 500. In the event that there are delays in transmission of the people count values, or mismatched timing information, the people count values are considered out of sync, resulting in an error condition (or an error flag being set). In some implementations, the master people counting segment may still output a total count of people in the open space 500. However, the output may be an estimate based on the received people count values or the last calculated total depending on the implementation. In some implementations, the data output by the sensors may also include other information such as camera mode information that provides an indication of the reliability of the people count values calculated by the sensors. For example, in a degraded mode of operation, the background image that the people counting sensor (e.g., thermal image sensor) relies on as a baseline is not reliable. Consequently, people count value output by the sensor is not guaranteed to be correct as compared to when the people counting sensor is in a normal mode. The segment input can, in some implementations, take into account the reliability indicator associated with the sensor data to decide whether to use the sensor data to calculate the total count of people in the space.

The calculation of, for example, an average temperature, maximum CO2 or digital OR on occupancy is simple as a new value can be calculated whenever an input value changes. An algorithm for counting the total number of people from distributed sensors, on the other hand, involves more than simply adding, averaging, or finding the maximum or minimum of the inputs. The master people counting segment (or the master room controller) may implement any of the methods described in reference to FIGS. 6, 7 and 8 for determining the total number of people in the space 500 that includes two or more distributed people counting sensors. Each of these methods will now be described in detail below.

Figure 6:
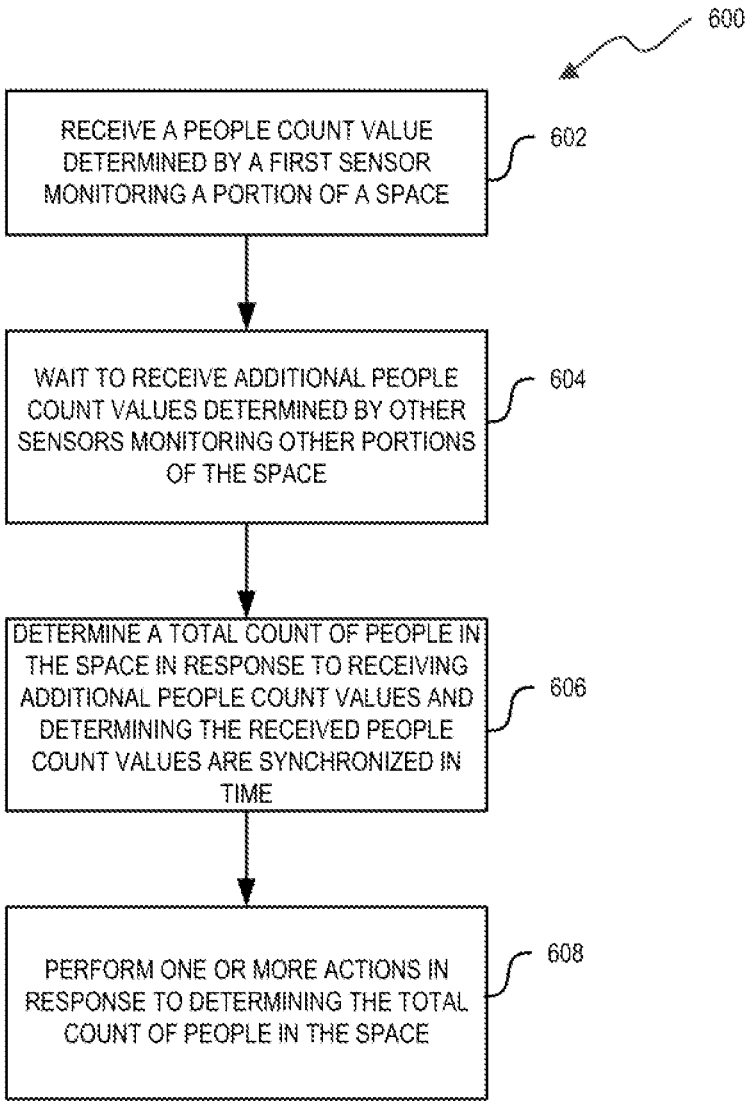
FIGS. 6-8 are logic flow diagrams illustrating example methods for counting the total number of people in a space that is monitored by a plurality of distributed sensors in accordance with some embodiments of the disclosed system.

FIG. 6 is a logic flow diagram illustrating an example method for counting people in a space that is monitored by a plurality of distributed sensors. The method may be implemented by a master room controller (i.e., room controller in the master segment) and specifically, the people counting segment in the master segment. At block 602, the segment receives a people count value determined by a first sensor monitoring a portion of a space. The first sensor is one of a plurality of sensors monitoring non-overlapping portions of the space. At block 604, the segment waits to receive additional people count values determined by other sensors monitoring other portions of the space. In some implementations, the waiting may be for a predefined period of time (e.g., short timer, less than 1 second) that is triggered each time a people count value output by a sensor from the plurality of sensors is received. In other implementations, the waiting may be for a predefined period of time (e.g., long timer, ten(s) of seconds) that is triggered by receiving of the people count value output by the first sensor. At block 606, the segment determines a total count of people in the space in response to receiving additional people count values from the rest of the sensors and determining that the received people count values are synchronized in time.

At block 608, one or more actions may be performed in response to determining the total count of people in the space. The one or more actions may be performed by the master room controller in some implementations. In some implementations, the one or more actions may be determined and/or performed by a control program or application that receives the total count of people as input. In some implementations, the one or more actions may include, automatically adjusting one or more parameters relating to indoor environment quality (IEQ) based on the total count of people in the space. In other implementations, the one or more actions may include automatically adjusting one or more parameters of an HVAC system based on the total count of people in the space. In yet other implementations, the one or more actions may include providing the total count of people in the space to a room control unit or a thermostat for controlling one or more parameters impacting climate condition of the space. In further implementations, the one or more actions may include alerting facility/safety managers when the number of people in a space exceeds the maximum or recommended threshold capacity for the space.

Figure 7:
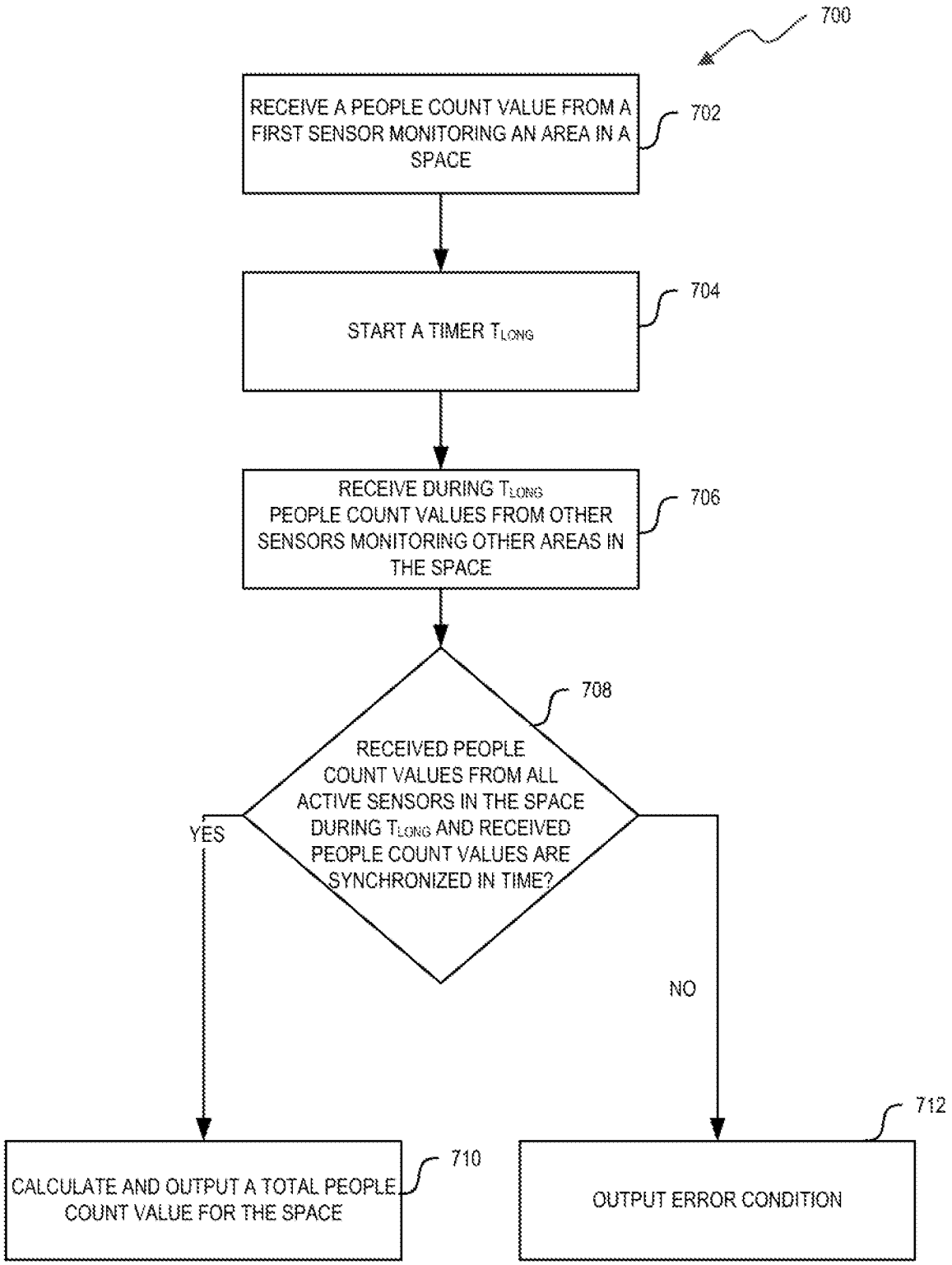

FIG. 7 is a logic flow diagram illustrating an example method for determining the total count of people in a space. The method 700 may be performed at a master room controller and specifically by a people counting segment in the master segment. At block 702, the segment receives a people count value from a first sensor monitoring a portion of a space. At block 704, on receiving the people count value, the segment triggers a timer $T_{LONG}$. The value of the long timer may be configurable (e.g., ten(s) of seconds). At block 706, the segment may receive additional people count values from other sensors monitoring other portions of the space during the duration of the long timer. At block 708, the segment may determine that people count values from all sensors that are active in the space were received during the duration of the long timer. The segment may also determine the received people count values from the sensors are synchronized in time (i.e., having matching timing information). In that case, the segment calculates the total count of people in the space by adding up the received people count values at block 710.

In the case when the master room controller does not receive people count values from all active sensors in the space during the duration of the long timer, the segment outputs an error condition at block 712. If any of the people count values output by the sensors are not in sync, the segment may also output an error condition (or raise a flag). In some implementations, in the case of an error condition, the segment may output the last calculated total. In other implementations, the segment may estimate the total number of people based on people count values that were received during the duration of the long timer.

Figure 8:
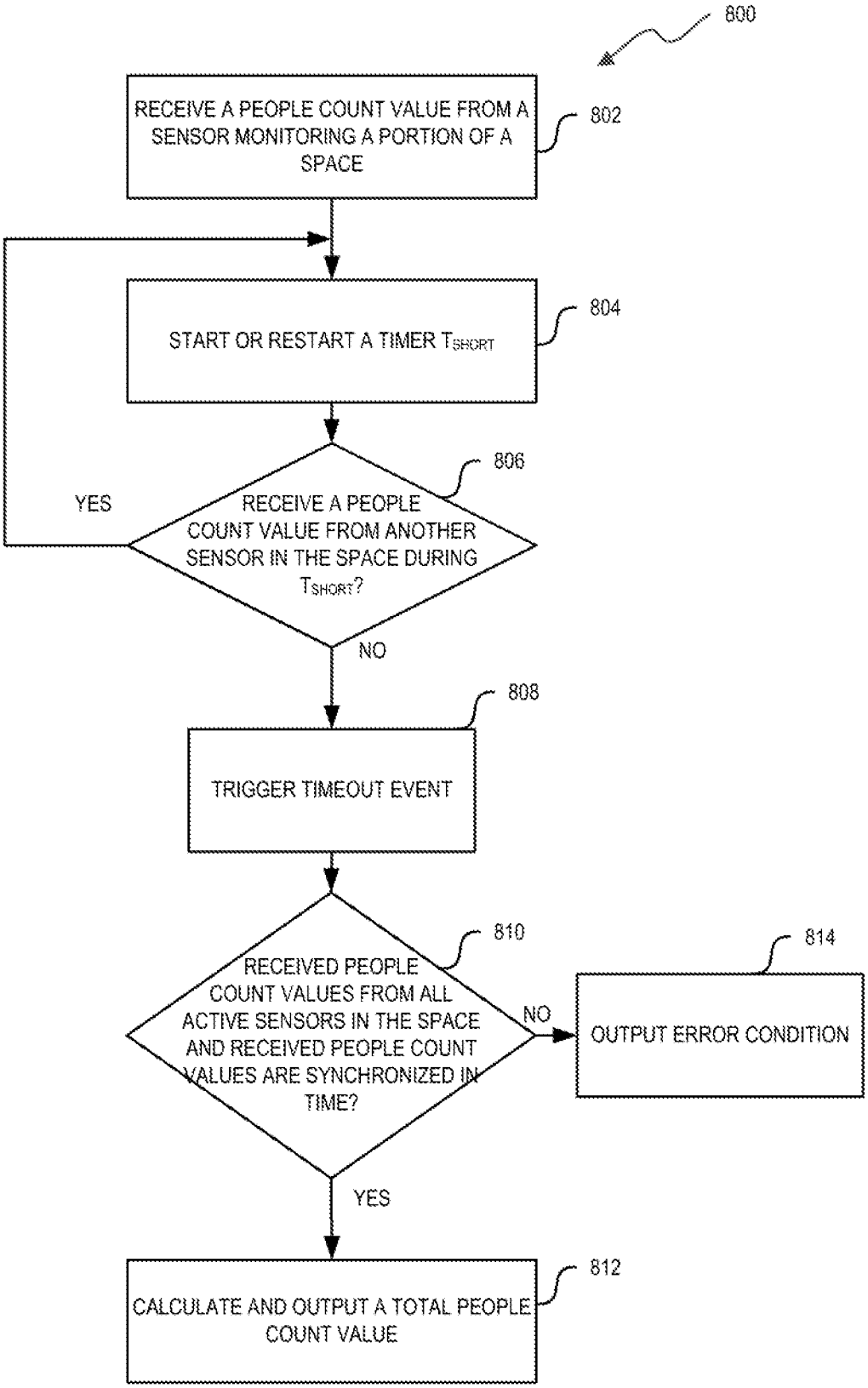

Another method of determining the total count of people in a space monitored by multiple distributed people counting sensors is depicted in FIG. 8. The method 800 may be performed by a master room controller, and specifically by a people counting segment in the master room controller. At block 802, the segment receives a people count value from a sensor monitoring a portion of a space. The receiving triggers a timer $T_{SHORT}$, which is of a shorter duration than the long timer described in reference to FIG. 7. By way of example only, the short timer may be less than 1 second long in some implementations. In some implementations, the value of the short timer may be selected by taking into account the time it takes for the people count value to transit from the sensor to the master room controller (via one or more slave room controllers).

In some cases, at block 806, when the segment receives a people count value from another sensor in the space during the duration of the short timer, the segment, in response, restarts the short timer at block 804. If at block 806 the short timer expires without the segment receiving another people count value from another sensor, a timeout event is triggered at block 808. The segment determines whether people count values from all active sensors in the space have been received and the people count values from the sensors are in sync (i.e., having matching timing information) at block 810. If so, the segment calculates the total number of people in the space by adding the people count values received from the active sensors in the space at block 812. When the segment determines at block 810 that a people count value from at least one of the active sensors in the space was not received, the segment may, instead of calculating the total number of people in the space, output an error condition (e.g., raise a flag). Similarly, if any of the people count values output by the sensors are not in sync, the segment may also output an error condition (or raise a flag). In some implementations, when there is an error condition, the segment may estimate and output the total number of people in the space using the received (and in sync) people count values. In alternative implementations, the segment may output the last calculated total count of people. One of the advantages of this method is the responsiveness. In other words, the total number of people can be determined quickly even if there is a loss of a message (i.e., people count value) in transit or one of the sensors goes offline.

Figure 9:
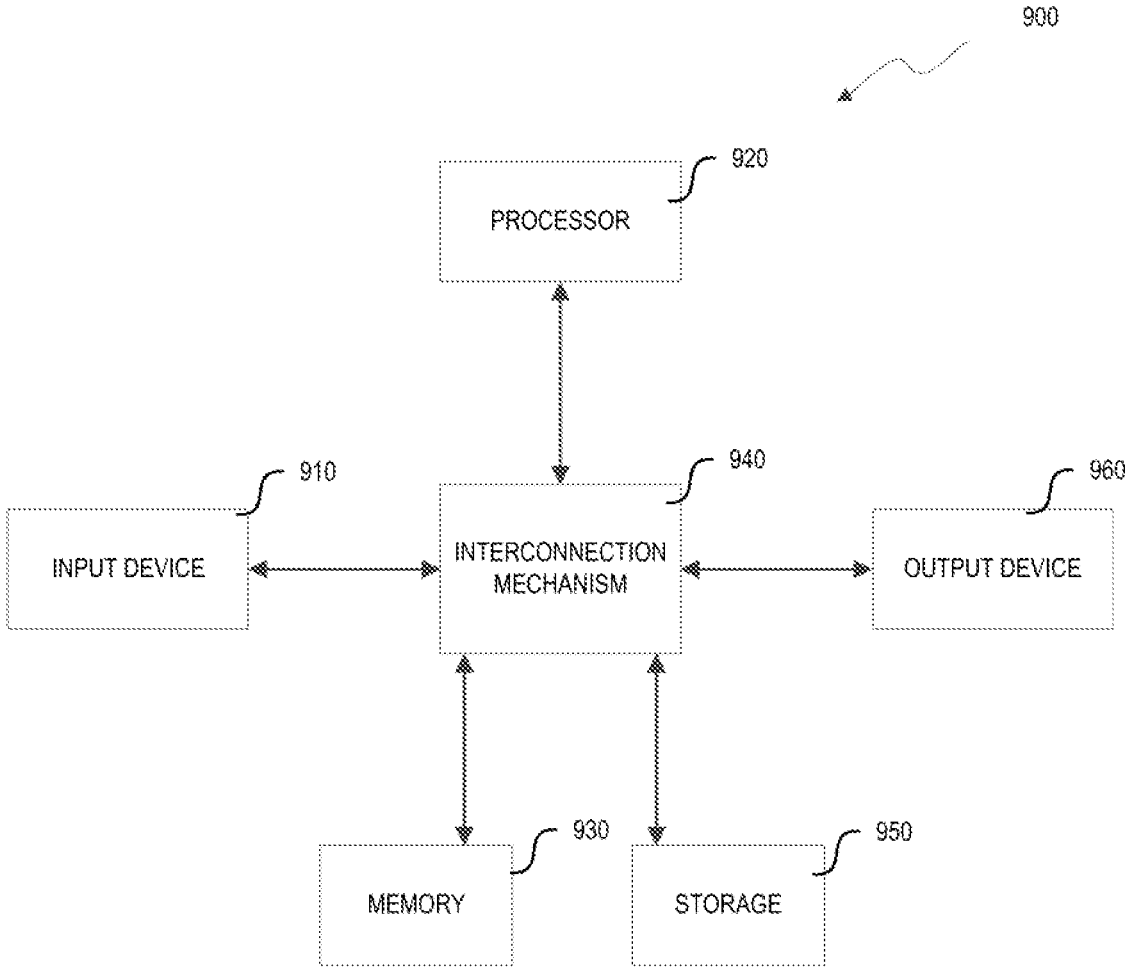
FIG. 9 is a functional block diagram of a general-purpose computer system that may be used to implement various embodiments of this disclosure.

FIG. 9 illustrates an exemplary computing system that may be used to implement various embodiments of this disclosure. In general, any general-purpose computer systems used in various embodiments of this disclosure may be, for example, general-purpose computers such as those based on Intel® Pentium-type processor, Motorola® PowerPC, Sun® UltraSPARC®, Hewlett-Packard® PA-RISC processors, or any other type of processor. Such computer systems may be either physical or virtual.

For example, various embodiments of the disclosure may be implemented as specialized software executing in a general-purpose computer system 900 such as that shown in FIG. 9. The computer system 900 may include a processor 920 connected to one or more memory devices 930, such as a disk drive, memory, or other device for storing data. Memory 930 is typically used for storing programs and data during operation of the computer system 900. The computer system 900 may also include a storage system 950 that provides additional storage capacity. Components of computer system 900 may be coupled by an interconnection mechanism 940, which may include one or more busses (e.g., between components that are integrated within the same machine) and/or a network (e.g., between components that reside on separate discrete machines). The interconnection mechanism 940 enables communications (e.g., data, instructions) to be exchanged between system components of system 900.

Computer system 900 also includes one or more input devices 910, for example, a keyboard, mouse, trackball, microphone, touch screen, and one or more output devices 960, for example, a printing device, display screen, speaker. In addition, computer system 900 may contain one or more interfaces (not shown) that connect computer system 900 to a communication network (in addition or as an alternative to the interconnection mechanism 940).

Figure 10:
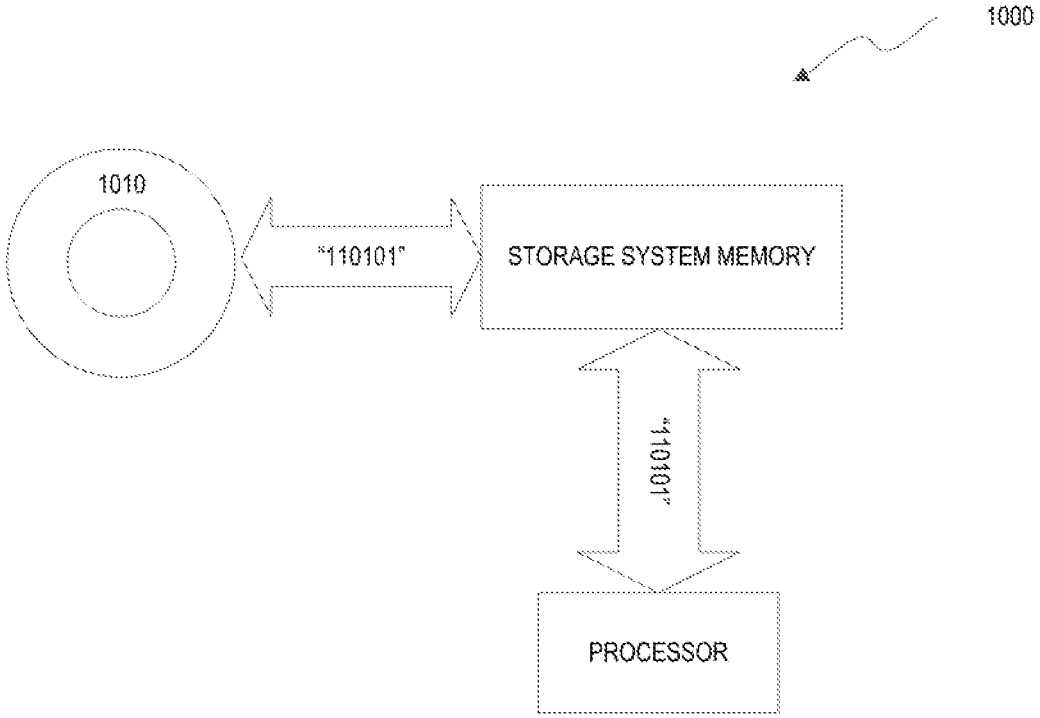
FIG. 10 is a functional block diagram of a general-purpose storage system that may be used to implement various embodiments of this disclosure.

The storage system 950, shown in greater detail in FIG. 10, typically includes a computer readable and writeable nonvolatile recording medium 1010 in which signals are stored that define a program to be executed by the processor 920 or information stored on or in the medium 1010 to be processed by the program to perform one or more functions associated with embodiments described herein. The medium may, for example, be a disk or flash memory. Typically, in operation, the processor 920 causes data to be read from the nonvolatile recording medium 1010 into storage system memory 1020 that allows for faster access to the information by the processor than does the medium 1010. This storage system memory 1020 is typically a volatile, random access memory such as a dynamic random-access memory (DRAM) or static memory (SRAM). This storage system memory 1020 may be located in storage system 950, as shown, or in the system memory 930. The processor 920 generally manipulates the data within the memory system 1020 and then copies the data to the medium 1010 after processing is completed. A variety of mechanisms are known for managing data movement between the medium 1010 and the integrated circuit memory element 1020, and the disclosure is not limited thereto. The disclosure is not limited to a particular memory 1020, memory 930 or storage system 950.

The computer system may include specially programmed, special-purpose hardware, for example, an application-specific integrated circuit (ASIC). Aspects of the disclosure may be implemented in software, hardware or firmware, or any combination thereof. Further, such methods, acts, systems, system elements and components thereof may be implemented as part of the computer system described above or as an independent component.

Although computer system 900 is shown by way of example as one type of computer system upon which various aspects of the disclosure may be practiced, it should be appreciated that aspects of the disclosure are not limited to being implemented on the computer system as shown in FIG. 9. Various aspects of the disclosure may be practiced on one or more computers having a different architecture or components shown in FIG. 9. Further, where functions or processes of embodiments of the disclosure are described herein (or in the claims) as being performed on a processor or controller, such description is intended to include systems that use more than one processor or controller to perform the functions.

Computer system 900 may be a general-purpose computer system that is programmable using a high-level computer programming language. Computer system 900 may be also implemented using specially programmed, special purpose hardware. In computer system 900, processor 920 is typically a commercially available processor such as the well-known Pentium class processor available from the Intel Corporation. Many other processors are available. Such a processor usually executes an operating system which may be, for example, the Windows 95, Windows 98, Windows NT, Windows 2000, Windows ME, Windows XP, Vista, Windows 7, Windows 10, or progeny operating systems available from the Microsoft Corporation, MAC OS System X, or progeny operating system available from Apple Computer, the Solaris operating system available from Sun Microsystems, UNIX, Linux (any distribution), or progeny operating systems available from various sources. Many other operating systems may be used.

The processor and operating system together define a computer platform for which application programs in high-level programming languages are written. It should be understood that embodiments of the disclosure are not limited to a particular computer system platform, processor, operating system, or network. Also, it should be apparent to those skilled in the art that the present disclosure is not limited to a specific programming language or computer system. Further, it should be appreciated that other appropriate programming languages and other appropriate computer systems could also be used.

In the preceding, reference is made to various embodiments. However, the scope of the present disclosure is not limited to the specific described embodiments. Instead, any combination of the described features and elements, whether related to different embodiments or not, is contemplated to implement and practice contemplated embodiments. Furthermore, although embodiments may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s).

It will be appreciated that the development of an actual commercial application incorporating aspects of the disclosed embodiments will require many implementation specific decisions to achieve a commercial embodiment. Such implementation specific decisions may include, and likely are not limited to, compliance with system related, business related, government related and other constraints, which may vary by specific implementation, location and from time to time. While a developer's efforts might be considered complex and time consuming, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

This disclosure is not limited in its application to the details of construction and the arrangement of components set forth in the following descriptions or illustrated by the drawings. The disclosure is capable of other embodiments and of being practiced or of being carried out in various ways. Also, the phraseology and terminology used herein is for the purpose of descriptions and should not be regarded as limiting. The use of "including," "comprising," "having," "containing," "involving," and variations herein, are meant to be open-ended, i.e., "including but not limited to."

The various embodiments disclosed herein may be implemented as a system, method or computer program product. Accordingly, aspects may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects may take the form of a computer program product embodied in one or more computer-readable medium(s) having computer-readable program code embodied thereon.

Any combination of one or more computer-readable medium(s) may be utilized. The computer-readable medium may be a non-transitory computer-readable medium. A non-transitory computer-readable medium may be, for example, but not limited to, an electronic, magnetic, optical, electromagnetic, infrared, or semiconductor system, apparatus, or device, or any suitable combination of the foregoing. More specific examples (a non-exhaustive list) of the non-transitory computer-readable medium can include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. Program code embodied on a computer-readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages. Moreover, such computer program code can execute using a single computer system or by multiple computer systems communicating with one another (e.g., using a local area network (LAN), wide area network (WAN), the Internet, etc.). While various features in the preceding are described with reference to flowchart illustrations and/or block diagrams, a person of ordinary skill in the art will understand that each block of the flowchart illustrations and/or block diagrams, as well as combinations of blocks in the flowchart illustrations and/or block diagrams, can be implemented by computer logic (e.g., computer program instructions, hardware logic, a combination of the two, etc.). Generally, computer program instructions may be provided to a processor(s) of a general-purpose computer, special-purpose computer, or other programmable data processing apparatus. Moreover, the execution of such computer program instructions using the processor(s) produces a machine that can carry out a function(s) or act(s) specified in the flowchart and/or block diagram block or blocks.

One or more portions of the computer system may be distributed across one or more computer systems coupled to a communications network. For example, as discussed above, a computer system that determines available power capacity may be located remotely from a system manager. These computer systems also may be general-purpose computer systems. For example, various aspects of the disclosure may be distributed among one or more computer systems configured to provide a service (e.g., servers) to one or more client computers, or to perform an overall task as part of a distributed system. For example, various aspects of the disclosure may be performed on a client-server or multi-tier system that includes components distributed among one or more server systems that perform various functions according to various embodiments of the disclosure. These components may be executable, intermediate (e.g., IL) or interpreted (e.g., Java) code which communicate over a communication network (e.g., the Internet) using a communication protocol (e.g., TCP/IP). For example, one or more database servers may be used to store device data, such as expected power draw, that is used in designing layouts associated with embodiments of the present disclosure.

It should be appreciated that the disclosure is not limited to executing on any particular system or group of systems. Also, it should be appreciated that the disclosure is not limited to any particular distributed architecture, network, or communication protocol.

Various embodiments of the present disclosure may be programmed using an object-oriented programming language, such as SmallTalk, Java, C++, Ada, or C# (C-Sharp). Other object-oriented programming languages may also be used. Alternatively, functional, scripting, and/or logical programming languages may be used, such as BASIC, Fortran, Cobol, TCL, or Lua. Various aspects of the disclosure may be implemented in a non-programmed environment (e.g., analytics platforms, or documents created in HTML, XML or other format that, when viewed in a window of a browser program render aspects of a graphical-user interface (GUI) or perform other functions). Various aspects of the disclosure may be implemented as programmed or non-programmed elements, or any combination thereof.

The flowchart and block diagrams in the Figures illustrate the architecture, functionality and/or operation of possible implementations of various embodiments of the present disclosure. In this regard, each block in the flowchart or block diagrams may represent a module, segment or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It is to be understood that the above description is intended to be illustrative, and not restrictive. Many other implementation examples are apparent upon reading and understanding the above description. Although the disclosure describes specific examples, it is recognized that the systems and methods of the disclosure are not limited to the examples described herein but may be practiced with modifications within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

We claim:

1. A method for counting people in a space monitored by a plurality of distributed sensors, comprising:

receiving a people count value output by a first sensor monitoring a portion of a space;

wherein the first sensor is one of a plurality of distributed sensors monitoring non-overlapping portions of the space;

wherein the plurality of distributed sensors are in communication with a plurality of controllers, and are synchronized in time;

waiting, for a predefined period of time, to receive additional people count values output by other sensors monitoring other portions of the space;

receiving the additional people count values output by the other sensors monitoring the other portions of the space;

determining, at a master controller from the plurality of controllers, a total count of people in the space in response to:

receiving the additional people count values, and determining that the received people count values are synchronized in time;

performing one or more actions based on the total count of people in the space, wherein a people counting segment object in the master controller waits to receive the additional people count values for the predefined period of time, and wherein the predefined period of time is triggered by one or more of (1) each time a people count value output by a sensor from the plurality of sensors is received, or (2) by the receiving of the people count value output by the first sensor.

2. The method of claim 1, wherein the people counting segment object includes a people counting segment input that combines the received people count values to determine the total count of people in the space.

3. The method of claim 1, wherein the people count value is a complex value having a people count value component and a timing component and wherein the timing component of the people count values are compared with each other to determine that the received people count values are synchronized in time.

4. The method of claim 1, wherein the one or more actions include:

automatically adjusting one or more parameters relating to indoor environmental air quality (IEQ) based on the total count of people in the space;

automatically adjusting one or more parameters of an HVAC system based on the total count of people in the space; or providing the total count of people in the space to a room control unit or a thermostat for controlling a climate condition of the space based on the total count of people in the space.

5. The method of claim 1, further comprising:

determining that a total count of people cannot be accurately calculated in response to determining that at least one of the received people count values is not synchronized in time with the other of the received people count values or was not received during a predefined time period.

6. The method of claim 1, wherein the sensor is one of a: multi-sensor comprising a plurality of sensors including a people counting sensor or a discrete people counting sensor.

7. A system for counting people in a space that is monitored by a plurality of distributed sensors, comprising:

a plurality of controllers including a master controller comprising a people counting segment object configured to:

receive a people count value output by a first sensor monitoring a portion of a space, wherein the first sensor is one of a plurality of distributed sensors monitoring non-overlapping portions of the space, wherein each sensor is hosted by a controller from the plurality of controllers, wherein each controller receives a people count value output by the respective sensor, and forwards it to the master controller;

wait, for a predefined period of time, to receive additional people count values output by other sensors monitoring other portions of the space;

receive the additional people count values output by the other sensors monitoring the other portions of the space; and determine whether the received people count values are synchronized in time;

determine a total count of people in the space based on the received people count values that are synchronized in time; and wherein the master controller is configured to perform one or more actions in response to determining the total count of people in the space, and further wherein the predefined period of time is triggered one or more of (1) each time a people count value output by a sensor from the plurality of distributed sensors is received, or (2) by receiving of the people count value output by the first sensor.

8. The system of claim 7, wherein the people count value is a complex value having a time component and a people count value component.

9. The system of claim 7, wherein the people counting segment object determines that a total count of people cannot be accurately calculated in response to determining that at least one of the received people count values is not synchronized in time with the other of the received people count values or was not received during a predefined time period.

10. The system of claim 7, wherein the one or more actions include:

automatically adjust one or more parameters relating to indoor environment quality (IEQ) based on the total count of people in the space;

automatically adjust one or more parameters of an HVAC system based on the total count of people in the space; or provide the total count of people in the space to a room control unit or a thermostat for controlling a climate condition of the space based on the total count of people in the space.

11. The system of claim 7, wherein the sensor is one of a: multi-sensor comprising a plurality of sensors including a people counting sensor, or a discrete people counting sensor.

12. A non-transitory computer-readable medium storing one or more programs comprising instructions which when executed by a machine, cause the machine to:

receive a people count value output by a first sensor monitoring a portion of a space;

wherein the first sensor is one of a plurality of distributed sensors monitoring non-overlapping portions of the space;

wherein the plurality of distributed sensors are in communication with a plurality of controllers and synchronized in time;

wait, for a predefined period of time, to receive additional people count values output by other sensors monitoring other portions of the space;

receive the additional people count values output by the other sensors monitoring the other portions of the space;

determine whether the received people count values are synchronized in time;

determine a total count of people in the space based on the received people count values that are synchronized in time; and perform one or more actions in response to determining the total count of people in the space, wherein the predefined period of time is triggered one or more of (1) each time a people count value output by a sensor from the plurality of sensors is received, or (2) by receiving of the people count value output by the first sensor.

13. The computer-readable medium of claim 12, wherein the people count value is a complex value having a value component and a timing component and wherein the timing component of the people count values are compared with each other to determine that the people count values are synchronized in time.

14. The computer-readable medium of claim 12, wherein the one or more actions include:

automatically adjusting one or more parameters relating to indoor environment quality (IEQ) based on the total count of people in the space;

automatically adjusting one or more parameters of an HVAC system based on the total count of people in the space; or providing the total count of people in the space to a room control unit or a thermostat for controlling a climate condition of the space based on the total count of people in the space.

15. The computer-readable medium of claim 12, wherein the instructions, when executed by the machine, further cause the machine to:

determine that a total count of people cannot be accurately calculated in response to determining that at least one of the received people count values is not synchronized in time with the other of the received people count values or was not received during a predefined time period.

16. The computer-readable medium of claim 12, wherein the sensor is one of a:

multi-sensor comprising a plurality of sensors including a people counting sensor or a discrete people counting sensor.

* * * * *